United States Patent [19]

Del Raso

[11] 4,247,112

[45] Jan. 27, 1981

[54] GOLFING PUTTING GAME APPARATUS

[76] Inventor: Americo Del Raso, 21858 River Oaks Dr., Rocky River, Ohio 44116

[21] Appl. No.: 920,628

[22] Filed: Jun. 29, 1978

Related U.S. Application Data

[62] Division of Ser. No. 728,526, Oct. 1, 1976, Pat. No. 4,114,887.

[51] Int. Cl.[3] ..... A63B 69/36

[52] U.S. Cl. ..... 273/176 H; 273/176 J

[58] Field of Search ..... 273/176 H

[56] References Cited

U.S. PATENT DOCUMENTS

| | | | |
|---|---|---|---|
| 2,334,540 | 11/1943 | Buffham | 273/176 H |
| 3,366,388 | 1/1968 | Del Raso | 273/176 H |
| 3,522,947 | 8/1970 | Anderson et al. | 273/176 H |
| 3,595,581 | 7/1971 | Anderson | 273/176 H |
| 4,114,887 | 9/1978 | Del Raso | 273/176 H |

*Primary Examiner*—George J. Marlo
*Attorney, Agent, or Firm*—Teare & Teare

[57] ABSTRACT

A miniature golf apparatus has a variable putting surface with a hole and sunken lights disposed adjacent each end. Consoles at each end provide for random selection of the putting surface contour and the illumination of lights to locate the commencement of putts to the hole at the opposite end of the device. To vary the putting surface, additional alternate manual selection is also provided. A pair of rotatably driven beams have a plurality of cross bars of different lengths resiliently and pivotally attached to extensions of the beams. The putting surface is disposed on clip members carried by the bars. Independent rotation of the beams about their longitudinal axes provide lengthwise undulations and widthwise slant of the putting surface. Crank arms and motors carried by some of the bars flex the bars to give a curvature to the putting surface.

11 Claims, 16 Drawing Figures

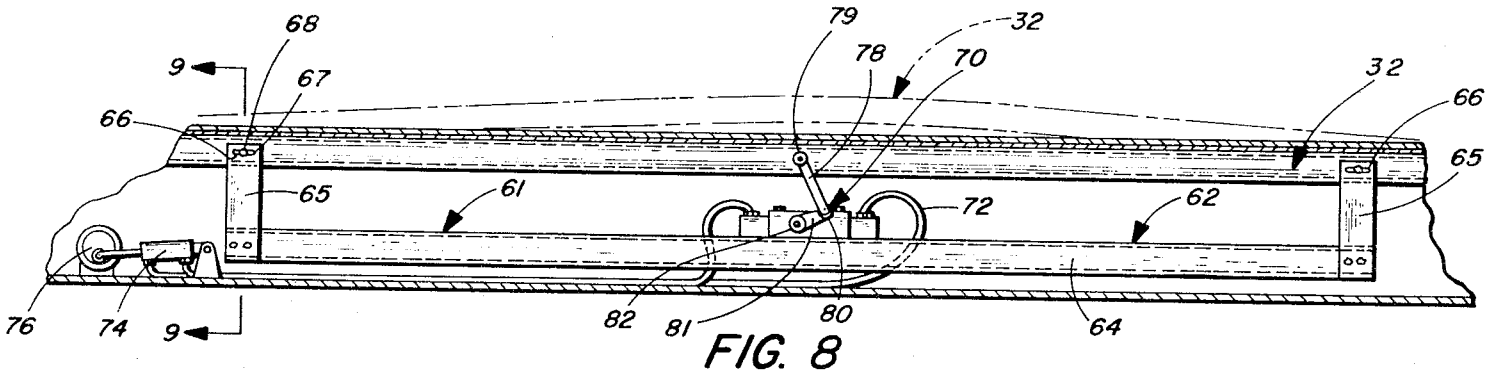
FIG. 8
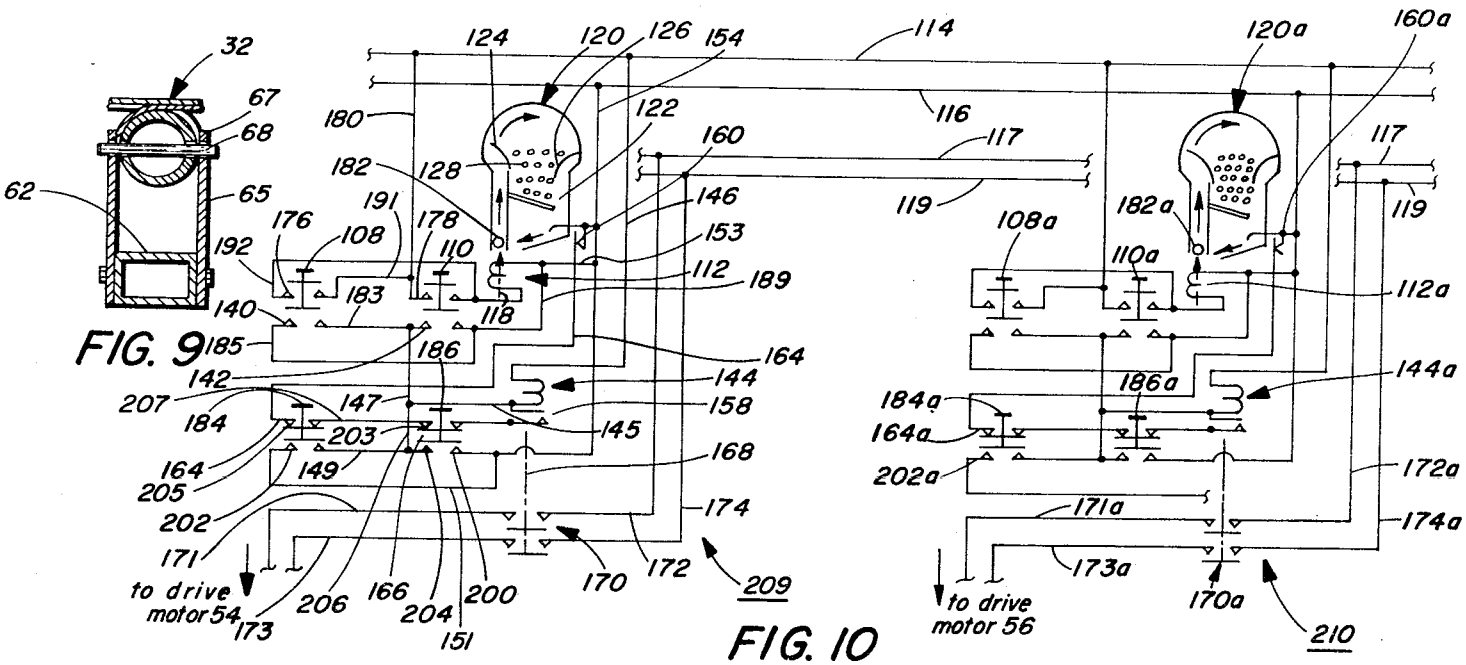
FIG. 9
FIG. 10

GOLFING PUTTING GAME APPARATUS

This is a Divisional of Application Ser. No. 728,526 filed Oct. 1, 1976, now U.S. Pat. No. 4,114,887, issued Sept. 19, 1978.

BACKGROUND OF THE INVENTION

The present invention relates to miniature golf devices and more particularly to a single device which is transformable into a plurality of "golf holes" by changing its shape.

There is often insufficient space for setting up eighteen holes of miniature golf in a particular location. Accordingly, in the past devices have been developed wherein a single device can be sequentially transformed into a series of golf holes by a sequential change of the putting surface.

Problems have existed in providing such a device which is simple, low cost, sturdy and reliable. A particular problem existed in trying to approximate the types of conditions which would be found on an actual putting green.

A still further difficulty was that such devices did not sufficiently closely enough approximate the circumstances of the unpredictable aspects of the putting phase of golf. For example, when one is playing actual golf, one does not know where the ball will come to rest on the green to begin the putting situation.

Moreover, in conventional miniature golf games the player soon can memorize the topography of a particular miniature golf course, thereby becoming soon bored with the particular course.

A still further disadvantage of conventional miniature golf courses is that the player cannot himself create the particular putting circumstance which he would like to practice.

Furthermore, the conventional devices lacked competitive incentives whereby an opponent could complicate the putting situation for his opponent.

SUMMARY OF THE INVENTION

A miniature golf device including means to vary the contour of the putting surface in several directions by supporting the putting surface on a plurality of cross members of variable height, cross-wise slant, and curvature. Changeable indicator means indicate the location of the ball for the commencement of each player's "putt out". Random actuating means can determine both the contour of the putting surface and the location of the beginning of the putt out. In the preferred embodiment, a golf hole is located at each end of the device, with the indicator means being diposed adjacent each end. A control console is located at each end to provide for random or determined selection of the contour and indicator lights.

By the foregoing arrangement, the actual conditions of golf play on a green can be closely simulated. By the use of the random selector means to select the indicator light for a player, the location of the ball at the start of the "putt out" is established by random selection. This approximates the situation in actual golf. In actual golf, the location of the ball on the green relative to the hole, at the commencement of the "putt out" is determined by the approach shot. No matter how skillfull the player is, the approach shot in actual golf has a random aspect as to where the ball stops on the green to begin the putting situation. Moreover, such location on the green will vary for each player due to the natural differences in each player's approach to the green.

Similarly, the device of the present invention can simulate the random topography of the line of putt as is the case in actual golf. The device of the present invention has means to vary the putting surface in longitudinal undulation, cross-wise slant and cross-wise curvature to provide a compound surface which approximates the kind of curved and undulating surface which one could find on a putting green. In actual golf, the contour which a player must putt depends on where his ball lands by chance on the green. By the use of the random selection means of the present invention, the topography is determined by chance as in actual golf. Thus, with the present invention, much of the same thrill of actual golf will be present, as well as a more realistic practice for actual putting.

By the use of two holes and consoles at each end, space is saved, yet the "terrain" to be played is still further varied since even with the same setting, the terrain is different when putting from one end than from the other. Yet the space occupied by the device is not increased. Electrical locking and transfer means allow only one "hole" and set of indicator lights to be actionable at a time.

In a variation of the use of the device, the manual instead of the random actuating means can be used. The use of the manual controls permits a player to attempt to "challenge" his opponent by manually selecting the location distance and type of contour over which his opponent must putt.

Another variation of the device is for a player himself to manually select the distance and contour so that he can create the putting conditions which he wishes to practice. In addition, a combination of manual and random selection can be made. As a result, a single sturdy reliable simple to operate and space saving device can provide for a variety of games at the player's choice, while closely approximating actual playing conditions.

BRIEF DESCRIPTION OF THE DRAWINGS

FIG. 8 is a fragmentary, vertical sectional elevation view of the flexing mechanism;

FIG. 9 is vertical section view taken along the line 9—9 in FIG. 8, illustrating the means for mounting the bracket assembly on the cross bar;

FIG. 10 is electro-mechanical schematic view of one form of the switching systems for actuating the variable contour drive means.

DESCRIPTION OF THE PREFERRED EMBODIMENTS

Figure 1:
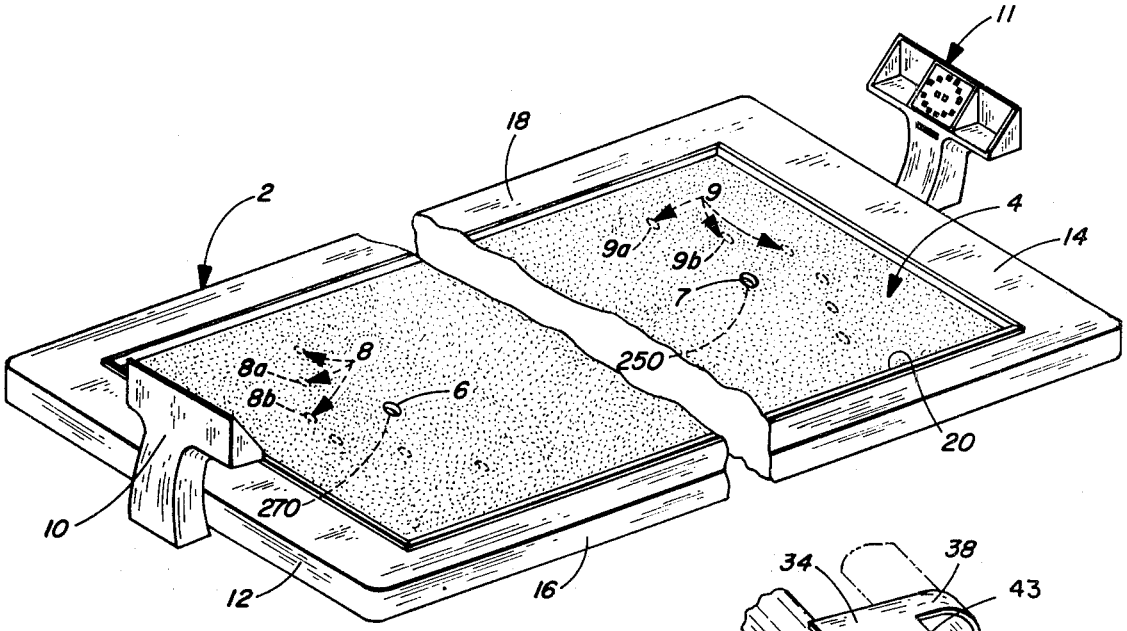
FIG. 1 is a perspective view, broken away, of the device of the invention.
Figure 12:
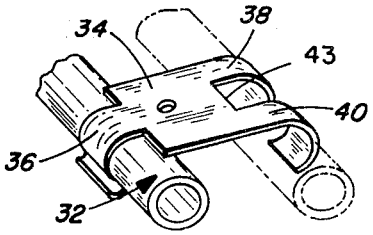
FIG. 12 is a fragmentary, generally perspective view showing its clip-like grid elements of the invention.

Now referring again more particularly to the drawings and with reference to FIG. 1, there is illustrated the miniature golf apparatus made in accordance with the present invention. As shown, the apparatus includes an elongated frame, designated generally at 2, which provides a supporting structure for a variable contour putting surface, designated generally at 4. The surface 4 is provided with a pair of oppositely disposed apertures or holes 6 and 7 which are disposed at opposite ends of the frame for receiving conventional size golf balls for playing a game, as will hereinafter be more fully described.

In the invention, each of the holes 6 and 7 are bordered with a series of symmetrically disposed indicator means in the form of lights as at 8 and 9. As shown, the lights 8 and 9 each comprise a set, such as six lights, with each set being operably associated with a control console, as at 10 and 11, disposed at opposite ends of the frame 2 for enabling the players to automatically operate the game. For example, each console generally contains control buttons, dials or knobs for selectively controlling the contour of the putting surface 4 and for automatically illuminating the respective light sets in accordance with the game to be played.

In accordance with the invention, the frame 2 is preferably of a polygonal, such as rectangular construction, which may be fabricated from metallic sheet material or the like to provide a generally hollow construction. In the embodiment shown, the frame 2 includes a pair of oppositely disposed end panels 12 and 14 (FIG. 1) and a pair of side panels 16 and 18 which conjunctively provide the rectangular shape shown. The playing surface 4 extends upward along the panels 12, 14, 16 and 18 to provide a bumper-like sidewall construction as at 20 (FIG. 3) to confine the playing surface. The sidewalls may be provided with edge strips, as at 21 (FIG. 3) to secure the playing surface to the sidewalls and to provide a finished construction.

Figure 3:
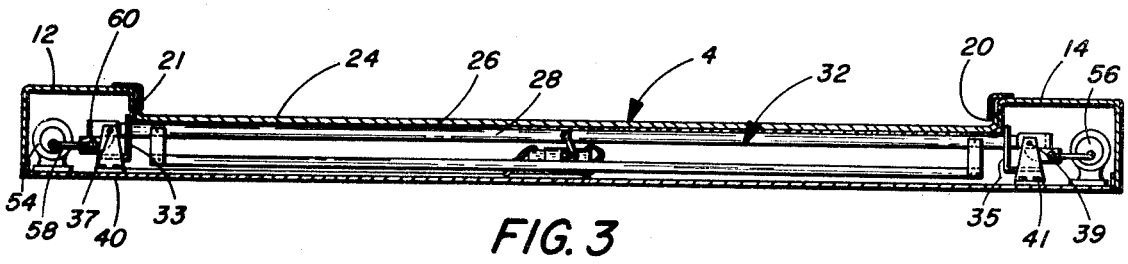
FIG. 3 is a vertical sectional elevation taken along the line 3—3 in FIG. 2 illustrating the drive means for the contour variation.
Figure 4:
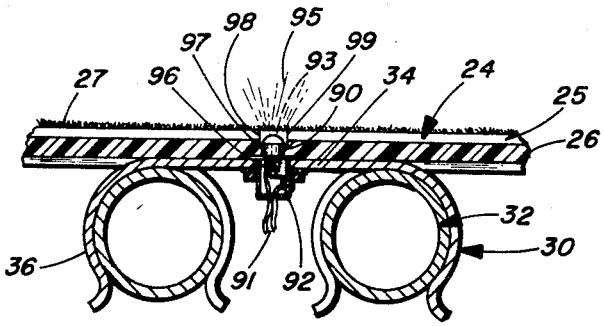
FIG. 4 is an enlarged fragmentary, elevation cross-sectional view taken along the line 4—4 in FIG. 2 showing the mounting of the putting surface support members mounted on the cross bars.
Figure 2:
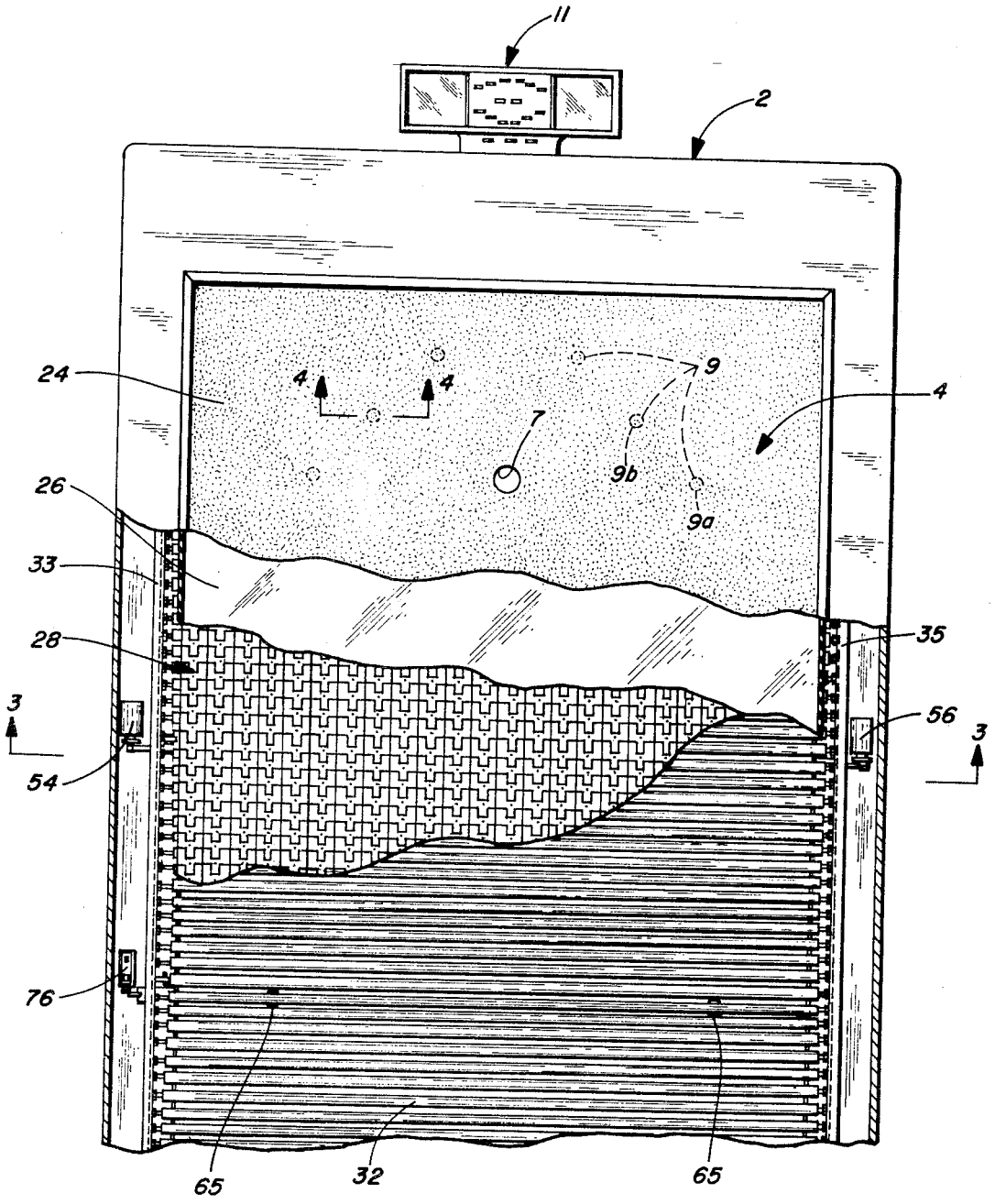
FIG. 2 is a fragmentary, partially cut-away and broken top plan view of the device of the invention.

As best seen in FIGS. 2 and 3, the putting surface 4 includes an upper fabric layer 24, an intermediate elastomeric layer 26 and a flexible grid layer 28 which conjunctively provide the flexible putting surface 4. As best seen in FIG. 4, the fabric layer 24 includes a substrate 25 of a fabric or plastic material with a tufted surface 27 to provide an artificial or simulated putting green surface. The intermediate layer 26 is preferably made of an elastomeric material such as rubber or the like, which provides a resilient cushioning for the outer layer 24. Also, this provides for additional strength and wear resistant characteristics in respect to the undergrid layer 28.

As best seen in FIGS. 2 and 4, the flexible grid layer 28 provides a supporting surface for the outer 24 and intermediate layers 26 which comprise the putting surface. In the form shown, the grid layer 28 is comprised of a plurality of individual clip-like grid elements, designated generally at 30, which are adapted for snap-action engagement with a series of transversely extending cross members 32. Preferably, the elements 30 are of a forked construction. For example, the elements include a top or base 34 with a generally C-shaped hook at one end, as at 36, and a pair of laterally spaced generally C-shaped hooks 38 and 40 at the other end for snap-action engagement with the cross member 32. Hence, the hooks 38 and 40 provide a slot, as at 43, adapted to accommodate an associated one of the hooks of an adjacent grid element to provide an articulated and substantially continuous supporting surface for the layers 24 and 26.

Figure 6:
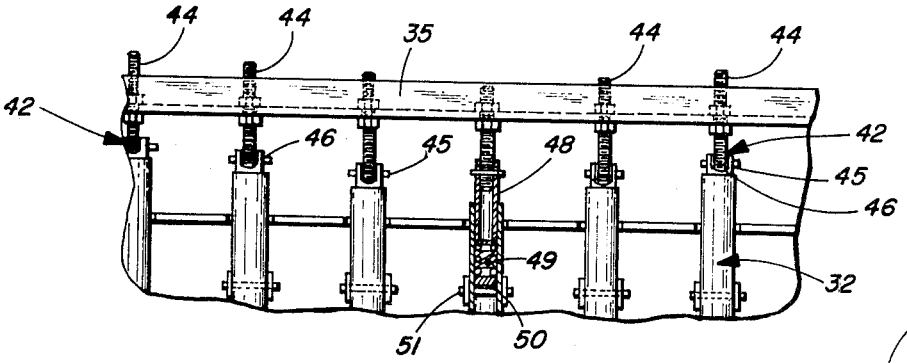
FIG. 6 is a fragmentary, partially broken-away, enlarged scale, plan view illustrating the pivotal cam action of the cross members to the lengthwise beams.
Figure 5:
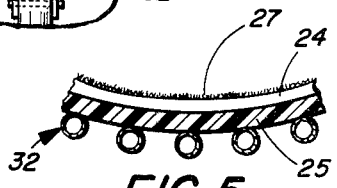
FIG. 5 is a schematic elevation view illustrating a typical lengthwise undulation produced by the varying height of the cross-members.
Figure 7:
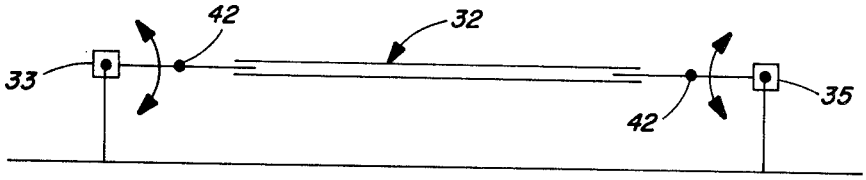
FIG. 7 and 7*a* to 7*d* are schematic illustrations of the movable action of the cross bars.
Figure 7A:
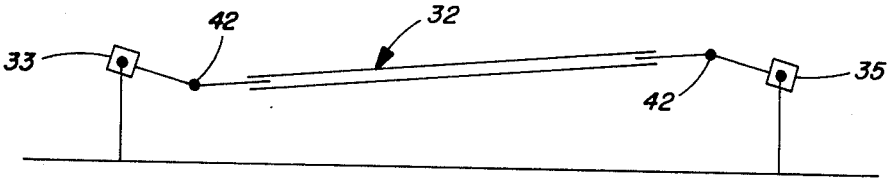
Figure 7B:
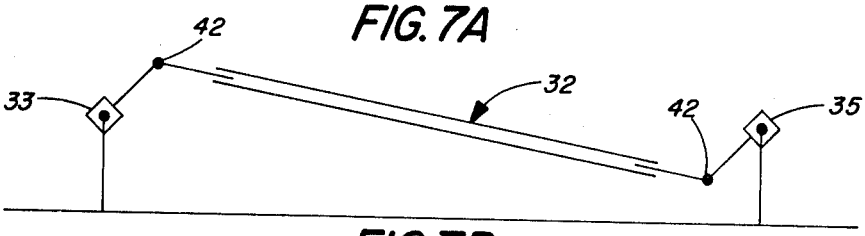
Figure 7C:
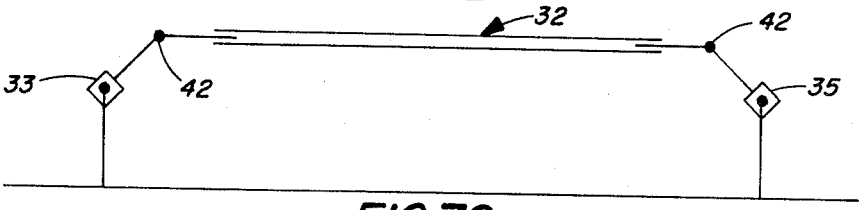
Figure 7D:
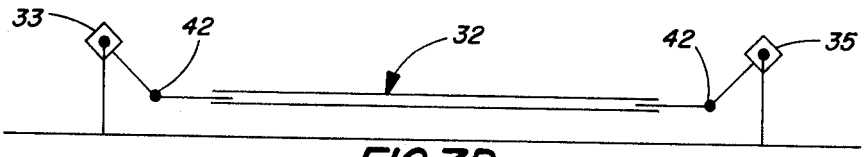

As best illustrated in FIGS. 3, 4 and 6 there is provided an electro-mechanical system for selectively controlling the lengthwise and widthwise structural contour of the putting surface 4 in response to actuation of the flexible grid layer defined by the grid elements 30. For this purpose, there is provided a plurality of transversely or widthwise extending cross-members 32 which, in the embodiment shown, are preferably of a hollow cylindrical tube-like construction. As seen in FIG. 2, the cross members 32 are pivotally attached at their opposed ends to a pair of oppositely disposed beam members 33 and 35 which extend at right angles thereto or in the lengthwise direction of the frame 2. The beam members 33 and 35 are each journaled in brackets for rotation at their opposed ends. For example one end of each beam is journalled as at 37 and 39, (FIG. 3) in the brackets 40 and 41 attached to the bottom of the frame 2. In the invention, the cross members 32 are pivotally connected, as at 42 to each of the respective beams 33 and 35. In the form shown, the pivotal connection 42 includes a selectively adjustable projection member 44, such as a screw or the like, (FIG. 6) which is threadably fixed at one end to the associated beam and at the other end pivotally connected to the cross member 32 via a pin 45 and slot 46 (FIG. 6) arrangement. Preferably, the pivotal connection includes a resilient construction to provide flexing of the cross members as will be described hereinafter. In the form shown, the resilient connection includes a coupling member 48 pivotally attached at one end to the screw 44 via the pin 45. The other end of the coupling 48 is telescopingly disposed within the open end of the cross member 32. A resilient compression spring 49 is disposed so as to bear at one end against the coupling 48 and at the other end against a plug element 50 fixedly held via a cross pin 51. By this arrangement, the cross members are enabled to incorporate a resilient axial movement so as to accommodate the flexing thereof.

As best seen in FIG. 3, the beams 33 and 35 are disposed for rotational movement about their longitudinal axis on brackets 40 and 41. In one form, drive motors 54 and 56 may be provided at generally the mid-point of the respective beams for rotating the same and hence, for pivoting the associated cross members 32 via the pivot connection 42, as aforesaid. For this purpose, there may be provided an articulated drive for each motor 54 and 56 which is preferably of identical construction. In this case, there may be provided an off-set or eccentric arm 58 attached to the motor at one end and at the otherend, as at 60, to the associated cross beam, such as 33 and 35, for rotating the respective beam members about its longitudinal axis upon actuating of the respective motor. By this arrangement upon actuation of the drive motors 54 and 56, upon control from the consoles 10 and 11, the cross members 32 and hence, the putting surface 4 can be contoured or shifted so as to provide the variation in a lengthwise direction dependent upon the selective length of the of the cross members 32 and the extent of rotation of the associated beam member, such as 33 or 35 and to vary the widthwise slant by the relative degree of rotation of the beams 33 and 35.

In the invention, there is further provided contour variation for the putting surface 4 by means of a flex mechanism, designated generally at 61, in FIG. 8. As shown, the mechanism 61 includes a bracket device 62 attached to the underside of one of the cross members 32; it being understood that any number of mechanisms may be employed with associated ones of the cross members 32 to provide the desired amount of flexure and hence contour the putting surface. As shown, the bracket 62 includes a cross arm 64 with a pair of integral upstanding arms 65 which are attached via a lost motion connection, as at 66, to the associated cross member 32. As shown, the lost motion connection 66 may comprise a slot 67 in the arm 65 which receives a pin 68 which projects from the cross member 32 so as to accommodate the flexure in the cross member, as illustrated in dotted line. The bracket 62 mounts a double-acting fluid cylinder 70 which is operably connected via supply lines 72 to a master fluid cylinder 74 which, in turn, is driven via a fluid drive electric motor 76. The fluid cylinder 70 is generally centrally connected to the underside of the associated cross member 32 via a first pivot link 78 pivotally attached at one end, as at 79, to the member 32 and at the other end, as at 80, to a second link 81 which, in turn, is pivotally connected, as at 82, to the cylinder 70. By this arrangement, upon actuation of the motor 76 and master cylinder 74 reciprocal, double-acting movement is imparted to the cylinder 70 for pivoting the links 78 and 81 in clockwise and counter-clockwise directions for flexing the cross member upwardly and downwardly, upward motion is illustrated in dotted line in FIG. 8. One or any number of flex mechanisms 61 may be provided for selectively flexing respective cross members for varying both the lengthwise and widthwise contour of the putting surface 4 as desired.

FIG. 4 illustrates one form of mounting indicator means in the form of lights beneath the playing surface. A light 90, having leads 91 to a source of power is mounted in receptacle 92 attached by soidering to the bottom of grid element 34. Apertures 96 in grid element 30, 97 in elastomeric layer 26 and 98 in substrate 25 permit the receptacle 92 and bulb 99 to be mounted so that the light 95 from bulb 99 will shine upwards through the tufts 27 and provide a visual indication of where a player should place his ball to begin putting.

Figure 11:
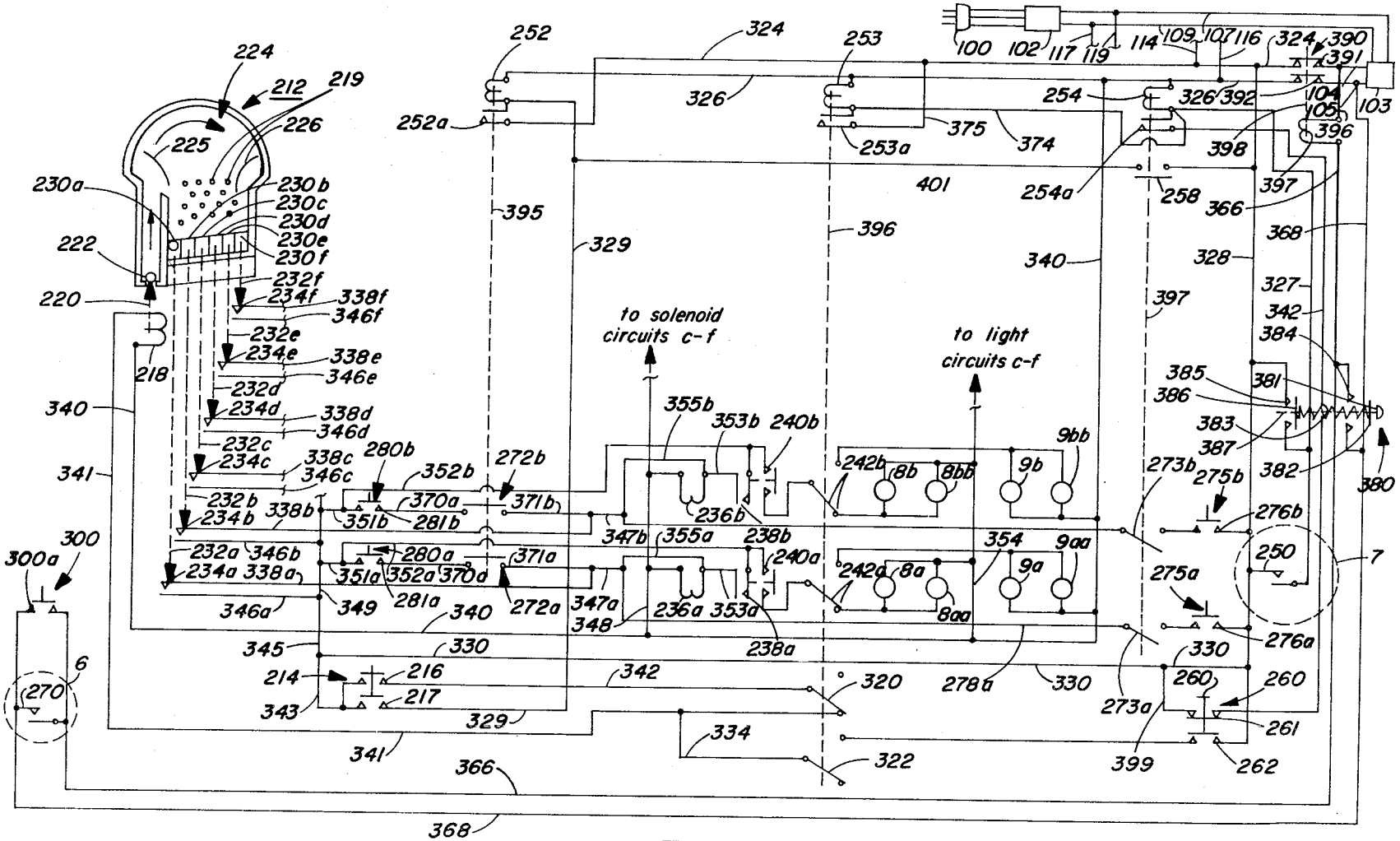
FIG. 11 is a electro-mechancial schematic view illustrating of one form the means for actuating the lights.

FIG. 11 illustrates the power circuitry for all electrical circuits. Plug 100 is adapted to be plugged into a 110 volt a.c. line. A switch 102 could be coin operated as known in the art, for turning the apparatus on and connecting lines 107 and 109 to power. Power lines 117 and 119 which branch off lines 107 and 109 provide the power for driving the motors such as motors 54, 56, and 76 (FIG. 2). A transformer 103 is connected to the main power by lines 107 and 109 to step down the voltage to the lower voltage used by control circuits, as known in the art. The power lines for all the control circuits are connected to transformer 103 through normally closed switch 390. Lines 324 and 326 provide the power for the energization and control of the putting location lights 8 and 9. Branch lines 114 and 116 provide the power for the motor drive control circuitry of FIG. 10 for controlling the actuation of motors 54, 55, 56 and 76. Turning to FIG. 10, circuitry is illustrated for actuating and controlling motors 54, 56 and 76 for varying the putting surface contour. Since the circuitry is identical for each motor, only circuit 209 for controlling motor 54, and circuit 210 for controlling motor 56 are shown. The numbering for the comparable components of circuit 210 is identical to that of circuit 209 except that the suffix "a" is added. Accordingly, only the operation of circuit 209 will be described, it being understood that the operation of circuit 210, and the identical (not shown) circuits for each of the flexing drive motors such as motor 76 will operate the same as circuit 209.

The main elements of a representative control circuit 209 for the drive motors, such as motor 54, for controlling the contour of the putting surface 4, are shown in FIG. 10. Lines 117 and 119 provide the higher power for driving motor 54 and lines 114 and 116 provide the lower power for the control circuitry for the drive of motor 54. Switch 108 on console 10 and switch 110 on console 11 independently actuate the random control of the duration of operation of motor 54. Switch 184 on console 10 and switch 186 on console 11 actuate the additional manual means for controlling the duration of operation of motor 54. Random timing mechanism 120 provides the random timing by which the random time is determined between the turning on of drive motor 54 and the turning off of the motor by the opening of normally closed microswitch 160.

The random operation of motor 54 from console 10 is accomplished by depressing random control switch 108. The closing of switch 108 closes normally spring biased open contacts 140 to actuate circuitry to connect motor 54 to power to cause it to operate to commence the rotation of beam 33. Specifically, the closing of contacts 140 connects motor actuation solenoid 144 to power. The current flow is by lines 114, 146, coil 144, lines 145, 147, 183, contacts 140, lines 185, 189, 153, 154 and 116. The flow of current through coil 144 closes solenoid contacts 158 which are mechanically coupled, as illustrated schematically at 168, to close switch 170 to connect motor 54 leads 171 and 173 to power lines 117 and 119 by lines 172 and 174. In order for the motor drive to continue (and beam 33 to rotate) until randomly turned off by the random timing mechanism, a holding circuit is provided to maintain motor actuation solenoid 144 energized when the random actuation switch 108 is returned by its spring bias (not shown) to its open position. The holding circuit for coil 144 is made by the closing of solenoid contact 158 by the initial energization of coil 144. The circuit is from line 114, 146, coil 144, contact 158, normally closed contacts 203, line 207, normally closed contacts 205, line 164, microswitch 160, lines 154 and 116.

The length of time that motor 54 is actuated to rotate beam 33 is determined by the random timing device activated by the closing of contacts 176 of switch 108, to energize solenoid 112 to cause plunger 118 to propel ball 182 into the timing maze 120. The current flow upon closing of contacts 176 is by line 114, 180, 191, contacts 176, line 192, coil 112, lines 153, 154 and 116. The energization of solenoid 112 causes plunger 118 to strike the ball 182 to project it into the maze 120 where it is deflected back and forth by springs 124 and 126 for a random period of time, and then falls by gravity through a maze of pins 128 where it is further randomly deflected until it falls through outlet 122 to open microswitch 160.

The opening of microswitch 160 interrupts the holding circuit thus de-energizing solenoid 144, and stopping the motor 54. Since the time it takes for the ball to be randomly bounced back and forth by springs 124 and 126 and deflected by pins 128 will vary each time the ball is projected into the maze, the timing between the actuation of solenoid 112 and plunger 118 (which time coincides with the turning on of the drive motor 54) and the turning off of motor 54 by the falling of ball 182 on microswitch 160 will be random. Thus, the rotation of beam 33 and the raising of one end of the cross members 32 and thus of the consequent effect on the contour of the putting surface will be random.

Identical circuits and identical switches, such as switch 180*a* of circuit 210 exist for each of the drive motors for effecting a variation in the putting surface contour. As a result, the contour variation effected by each motor, such as motor 56 for rotating beam 35 and each of the flex motors, such as motor 76 will be independently random.

In the other operation of the device, where the players decide to chose the contour, manual switches such as switch 184 on console 10 are provided. The depressing of switch 184 opens contacts 205 to open circuit the holding circuit for the solenoid 144, and closes contacts 202 to energize solenoid 144 for as long as the switch button 184 is depressed. Thus, the player can maintain motor 54 on until beam 33 has rotated by the amount necessary to achieve the desired contour component produced by such beam rotation. The circuitry for manual energization of coil 144 on closing of contacts 202 is by lines 114, 146, coil 144, lines 145, 147, 149, contacts 202, and lines 151, 154 and 116.

Console 11 contains switches which are identical in operation to the switches described for console 10. For example, the console 11 switches for random and manual actuation of motor 54 are switches 110 and 186 respectively. As a result, the flexing of the contour for the putting surface can be actuated from either console.

It is to be understood that all push button switches shown in FIGS. 10 and 11 are spring biased by springs (not shown) to return to their upward position as soon as finger pressure is removed therefrom.

FIG. 11 illustrates the circuitry for random (and supplemental manual) selection of the location lights 8 and 9. The principal components for the random selection are push button random actuation switches 214 on console 10 and 260 on console 11 for initiating the random selection; random light selector 212 and its associated actuation solenoid 220 for making the random selection; light actuation solenoids 236*a*–236*f* turning the selected light on; lights 8*a*–8*f* and 9*a*–9*f* to indicate the location for beginning a "putt out" disposed beneath the putting surface; corresponding lights 8*aa*–8*ff* and 9*aa*–9*ff* on consoles 10 and 11 respectively to provide an indication on the console of lights which have already been selected; microswitches 270 and 250 located in cups 6 and 7 respectively, for preparing the indicator light circuitry for putting back towards the other cup once the putting in one cup is completed; transfer solenoid 253 for switching the circuit actuation to the console adjacent the cup wherein the putting has been completed so that play may commence back toward the other cup; isolation relays 252 and 254 for maintaining the manual controls deactivated while the random selection is in operation, and reset push buttons 300 and 380 on consoles 10 and 11 respectively for cancelling an erroneous selection.

The random actuation switches 214 on console 10 and 260 on console 11 have the dual functions of initiating the actuation of the random light selection mechanism and initiating the deactivation of the manual controls while a light is being randomly selected. The electrical connections for the actuation of the lights from console 10 for playing therefrom towards cup 7 will be discussed first.

Contacts 216 of switch 214 are connected in series with solenoid coil 218 to energize the coil when contacts 216 are closed by pressing switch 214. The circuit to energize solenoid 218 upon closing of switch 214 is by lines 324, 328, 330, 343, contacts 216, line 342, contacts 320, line 341, coil 218, and lines 340 and 326.

A maze shown generally at 224 is disposed adjacent solenoid 218 so that solenoid plunger 220 can strike a small selector ball 222 of metal or the like to initiate the random selection of the putting light for a player. Maze 224 has a pair of light spring metal leaf springs 225 and 226. Spring 225 is positioned, and is sufficiently light construction, to deflect to allow the selector ball 222 to enter the maze. Springs 225 and 226 are so positioned and so curved to allow the selector ball 222 to bounce back and forth to provide a random lateral location from which the ball can fall by gravity towards the bottom of the maze. The maze 224 is inclined from top to bottom to allow the selector ball 222 to fall be gravity towards the bottom of the device. A row of pins 219 are spaced along the path of the selector ball 222 to provide further random directional deflection of selector ball 222. A row of bins 230*a*–230*f* are disposed at the bottom of the random selector device 224. At the bottom of each bin is a spring biased plunger (spring not shown) 232*a*–232*f* respectively. The plungers are adapted to move downwardly when selector ball 222 falls by chance in one of the bins 230*a*–230*f* to close respective contacts 234*a*–234*f*. A passageway (not shown) is provided behind each bin for the selector ball 222 to return to the position in front of the plunger 220 in preparation for the next random selection.

Each set of contacts 234*a*–234*f* are connected in individual series circuits to respective solenoids 236*a*–236*f* (only 236*a* and 236*b* are shown) to switch respective lights 8*a*–8*f*, and 8*aa* to 8*ff* on (only lights 8*a*, 8*b*, 8*aa* and 8*bb* are shown). As an example, the circuitry for energizing light switching solenoid 236*a* when contacts 234*a* are closed by plunger 232*a* is by lines 324, 328, 330, 345, 346*a*, contacts 234*a*, lines 338*a*, 347*a*, 355*a*, coil 236*a*, lines 348, 340 and 326.

Holding circuits are provided for solenoids 326*a*–236*f* to hold the solenoids energized even though ball 222 has rolled from and is no longer closing randomly selected switch from switches 234*a*–234*f*. For example, the holding circuit for solenoid 236*a* is by lines 324, 328, 330, 345, 349, 351*a*, 352*a*, contacts 238*a*, line 353*a*, solenoid coil 236*a*, line 348, 340 and 326.

The random energization of one of the solenoids 236*a*–236*f* switches the corresponding one of the lights 8*a*–8*f* and 8*aa*–8*ff* on, due to the closing of contacts 240*a* by solenoid 236*a*. For example, the circuit to turn on lights 8*a* and 8*aa* is by lines 324, 328, 330, 345, 349, 351*a*, 352*a*, contacts 240*a*, normally closed contacts 242*a*, parallel connected lights 8*a* and 8*aa*, lines 354, 340 and 326. Because of the holding circuit, previously described, the light remains lit even though finger pressure is removed from switch 214.

In order to insure that inadvertent pressing of the manual operation switches during the random selection will not occur, an isolation circuit is provided. The isolation circuit is energized upon closing of random switch 214 by the closing of contacts 217 to energize isolation relay 252 to move manual circuit interrupter switches such as 272*a*–272*f* open. (Only switches 272*a* and 272*b* are shown). The circuit to energize manual operation isolation relay 252 is by lines 324, 328, 330, 343, contacts 217, line 329, coil 252, line 326. The manual interrupter switches, such as 272*a* and 272*b* are mechanically coupled as shown schematically at 395 to solenoid contact 252*a*, and such interrupter switches are thereby opened when solenoid contact 252*a* closes upon energization of solenoid coil 252. In order to maintain the manual operation circuits open even though finger pressure is removed from switch 214, a holding circuit for solenoid coil 252 is provided. The holding circuit is by line 324, contacts 252*a*, coil 252, and line 326.

Putting cup 7 has a microswitch 250 disposed for resetting the circuitry for play from adjacent cup 7 and console 11 back toward cup 6 and console 10. The main components are microswitch 250 to initiate the resetting when a ball drops in cup 7; isolation solenoid 254 to connect the console 11 actuatable manual switches potentially into the circuit; transfer solenoid 253 to transfer lights 8*a*–8*f* and 8*aa* to 8*ff* out of the potentially actuatable circuitry and transfer lights 9*a*–9*f* and 9*aa*–9*ff* into the potentially actuatable circuitry so that the "8" series lights that are lit will go out and the "9" series lights are available for selection.

The closing of microswitch 250 in hole 7 by a ball falling in the hole completes a circuit to energize transfer relay 253 to prepare the circuitry for the random actuation of the "9" series of lights and the turning off of the lights of the "8" series which were lit when playing from console 10 toward hole 7. The circuit for energizing transfer relay 253 is lines 324, 328, contacts 250 closed by a ball falling into hole 7, lines 327, 374, coil 253, and line 326. A holding circuit is provided for keeping solenoid coil 253 energized even though the ball is removed from cup 7. The holding circuit is by line 324, 375, solenoid contacts 253*a* closed by energization of solenoid coil 253, coil 253, and line 326. Mechanical coupling, shown schematically at 396 connects switches 242*a*–242*f*, 320 and 322 to solenoid contact 253*a* so that while coil 253 is energized, closing solenoid contact 253*a*, light transfer switches 242*a*–242*f* are moved to disconnect the "8" series lights and connect the "9" series in circuit. Solenoid contact 253*a* is also mechanically coupled to the transfer switches 320 and 322 respectively such as by coupling 396 so as to open circuit the random selection actuating switch 214 and close transfer switch 322 to place random selection actuating switch 260 in circuit.

Push button switch 260 on console 11 provides for the random light selection in playing from console 11 back towards cup 6 when transfer switch 322 is closed (as it is after a ball has fallen in hole 7 as aforesaid). The closing of switch 260 on console 11 by a player's finger closes contacts 262 to connect solenoid 218 to power to initiate the random selection by the projection of small ball 222 through the maze as previously described in connection with actuation by push button switch 214 on console 10. Since the closing of contacts 250 by a ball entering hole 7 switches the "9" series lights into the circuit, one of the "9" series lights will be lit by the small ball 222 falling in one of the bins 230*a*–230*f* with the eventual actuation of one of the corresponding solenoids 236*a*–236*f* to close solenoid contacts 240*a*–240*f* to connect corresponding "9" series lights to power to provide a randomly selected location for a player's golf ball for putting back towards hole 6.

Hole 6 contains a microswitch 270 therein adapted to close when a ball falls therein when putting from adjacent console 11 to hole 6. Microswitch 270 disconnects all solenoids from power allowing the spring biases to return all of the solenoid 252, 253, and 254 switches to their original positions to reset the apparatus for putting from console 10 towards hole 7. The circuit is by lines 104, 396 and coil 397, lines 366, contacts 270, lines 368 and 105. Energization of coil 397 moves plunger 398 (shown schematically) to open contacts 391 and 392.

In order that the same apparatus can also be played manually, manual light selection switches are provided for each light circuit. For example, manual switches 280*a* and 280*b* on console 10 and manual switches 275*a* and 275*b* on console 11 are shown. Manual light selection switch 280*a* is connected in series with light actuation solenoid 236*a*. The circuit for connecting solenoid 236*a* to power by light selection switch 280*a* is by lines 324, 328, 330, 345, 349, 351*a*, contacts 281*a*, line 370*a*, normally spring biased closed switch 272*a* (spring not shown), line 371*a*, 347*a*, 355*a*, coil 236*a*, lines 348, 340, and 326.

A holding circuit is also formed for maintaining the selected "8" series lights lit when the finger pressure is removed from the manual actuation switch which actuated the light. For example, the holding circuit for the 8*a* lights is by lines 324, 328, 330, 345, 349, 351*a*, 352*a*, holding contacts 238*a* closed by solenoid 236*a*, lines 348, 340 and 326.

Manual light selector switches are also provided for console 11, such as switches 275*a* and 275*b*. Manual light selector switches on console 11, such as switches 275*a* and 275*b* are potentially placed in circuit when a golf ball falls in hole 7 to close microswitch 250. The closing of microswitch 250 energizes isolation relay 254 to close manual circuit interruption switches, such as switches 273*a* and 273*b*. The circuit for energizing isolation relay 254 on the closing of contacts 250 is by lines 324, 328, contacts 250 closed by a golf ball falling in hole 7, line 327, coil 254, line 326. A holding circuit is provided to maintain isolation coil 254 energized even though the golf ball is removed from hole 7. The energization of coil 254 closes solenoid contacts 254*a* to form the circuit of line 324, 328, 330, 399, normally closed contacts 261, line 342, solenoid contacts 254*a*, solenoid coil 254 and line 326. Since solenoid contact 254*a* is mechanically coupled, as shown schematically at 397, to the manual circuit interruption switches such as switches 273*a* and 273*b*, such switches will be closed in preparation for play from console 11 back towards hole 6. If a player elects to use the manual switches, the particular switch selected will light the corresponding "9" series light. For example, if switch 275*a* is depressed, lights 9*a* beneath the putting surface and corresponding light 9*aa* will light on console 11. For example, the circuit when manual light selector switch 275*a* is depressed is by line 324, 328, contacts 276*a* closed by depressing switch 275*a*, contacts 273*a* held closed by the isolation relay 254 holding circuit, line 278*a*, 355*a*, coil 236*a*, line 348, 340 and 326. A holding circuit for maintaining the selected "9" series lights lit when the finger pressure is removed from the manual actuation switch is provided for each manual switch circuit. For example, the holding circuit for the 9*a* light is by lines 324, 328, 330, 345, 351*a*, 352*a*, holding contacts 238*a* closed by solenoid 236*a*, coil 236*a*, lines 348, 340 and 326.

A reset control system is also provided. By the reset system if the random or a manual actuation switch is inadvertently pushed, the unwanted lights can be cancelled.

Reset switch 300 (FIG. 11) is actuated at console 10. The pressing of reset switch 300 energizes reset relay coil 397 causing contacts 391 and 392 to open. The energization of relay coil 397 is by lines 104, 396, coil 397, lines 366, switch 300*a*, lines 368 and 105. Energization of coil 397 moves armature 398 (shown schematically) to open contacts 391 and 392. The opening of contacts 391 and 392 disconnect lines 324 and 326 from power and return all the spring biased control switches to their original normally open or normally closed positions.

Reset switch 380 is actuated at console 11. Switch 380 has contacts 385 which are made and broken by contacts 386 at the end of a spring 383 mounted on plunger 387 of switch 380. Contact member 382 is mounted on the plunger 387 a sufficient distance from contacts 386 at the normally open position of switch 380 so that when rod 387 moves upon pressure on button 381 of switch 380, contacts 386 at the end of spring 383 will close contacts 385 before contacts 382 on plunger 387 closes contacts 384 as spring 383 compresses. When contacts 385 are closed the circuit is the same as that described when contacts 250 close to prepare for putting from console 7 to hole 6, energizing solenoids 253 and 254 and their associated holding circuits to move transfer switches such as 242*a* and 246*b* to potentially connect the "9" series lights and open contacts 320 and close contacts 322. The closing of contacts 384 energizescoil 397 to disconnect all solenoids from power by opening switch 390. The circuit is by lines 104, 396, coil 397, line 366, contacts 384 line 368 and 105, causing plunger 398 to open switch 390 and its contacts 391 and 392.

Means are also provided for commencing the game from console 11 rather than console 10. When this is desired, then the system must be switched to operation from console 11 before the selection of the contour and lights is begun. This switching is accomplished by depressing reset switch 380. The closing of reset switch 380 energizes relays 252, 253 and 254. The energization of relay 253 switches the transfer contacts, such as 240*a* and 240*b* to the "9" series potential connections, and places the random actuator switch 260 in potential circuit, as previously described. Similarly, the energization of relay 254 also closes manual interrupter contacts such as 273*a* and 273*b* to place the manual switches such as 275*a* and 275*b* in potential circuit, as previously described. In addition, the energization of relay 254 closes contacts 258 to energize relay 252 to open circuit the manual switches from console 10 by the closing of relay contacts 252*a* to which such manual interrupter contacts 272*a* and 272*b* are mechanically coupled as at 395. The circuit for energizing relay 252 is by lines 324, 328, contacts 258, line 401, coil 252, and line 326.

The previously described means for automatic deactivation of the switches of one console when playing from the other console, are included so that play is controllable from only one console at a time. In this way a player or bystander at the end towards which the play is to go cannot change the selections made at the opposite console. As a result, play commences in only one direction at a time, with each direction of play constituting one "golf hole"

OPERATION

Assume the apparatus is plugged in, and turned On by placing a coin in box 102. Assume further that there are two players who decide to play the game entirely by the use of the random controls. One of the players stands at console 10 (FIG. 1) and pushes the random control buttons 108, 108*a*, (FIG. 10) and the comparable button (not shown) for the flex controls. The actuating of the buttons also causes energizing of the solenoids 118, 118*a* and the comparable solenoid (not shown) for the flexing controls. Each of the timing balls actuated by the respective solenoids then passes through its associated maze, such as mazes 120 and 120*a* and a comparable maze for the flex mechanism (not shown), with the time of passing of each ball through the maze being random. The actuation of the buttons energizes drive motors 54, 56 and the flex motors such as 76 (FIG. 2) causing a progressive compound variation of the putting surface 4 by the variation of the height and angle of the cross members 32, such as one of the positions of FIGS. 7*a* through 7*d* and varying the flex of some thereof by the linkage to the drive motors previously described.

Each timing ball, such as 182 and 182*a*, *after passing through its maze trips a microswitch such as 160 and 160a* to open the circuit between the drive motors such as motors 54 and 56 and their respective power leads 172 and 174 to stop the motors. Since the ball for the random control for each motor will randomly open the respective motor drive circuit at different times, each motor will randomly be actuated for a different time with a consequent separate random variation of the height, inclination and flexing of cross members 32, with a consequent random variation of the compound contour of the putting surface 4.

The first player then determines the location of his "Putt out" by pressing the random light selector 214 on console 10. The pressing of the button 214 closes contacts 217 to energize isolation solenoid 252 which opens the normally spring biased closed manual interruption switches such as 272*a* and 272*b*, so that only the random selection circuitry is operative. The pressing of button 214 also closes contacts 216 to energize solenoid 218 to project selection ball 222 into the maze 224 where it falls by random chance into one of the bins 230*a* through 230*f* to light the "8" series light operably connected for illumination to the bin into which the selection ball falls. For example, the selector ball 222 is shown falling into bin 230*a*. This will cause energization of solenoid 236*a* and consequently of light 8*a* below the playing surface to locate where the golf ball should be placed and light 8*aa* on console 10 to show what light has already been selected. The player then places his ball on the putting surface 4 over the illuminated light 8*a*. The second player then pushes button 214 to repeat the process to select his light. Assume, for example, that his ball lands in bin 230*b* to actuate solenoid 236*b* to illuminate light 8*b* under the playing surface and light 8*bb* on console 10. The second player then places his ball over light 8*b* to begin his "putt out" therefrom. Both players then putt towards cup 7. When the first ball falls into cup 7 it trips microswitch 250 to set the circuitry for play from adjacent console 11 to cup 6. The closing of microswitch 250 energizes transfer relay 253 to connect the "9" series lights, such as lights 9*a* through 9*f* to the actuating circuitry and disconnect the "8" series lights therefrom. The closing of microswitch 250 also energizes solenoid 254 to close normally spring biased open manual interruption switches such as 273*a* and 273*b* to potentially connect the manual switches on console 11 into the circuit. The players then repeat the process of selection at console 11 as performed at console 10 by pushing random selection switch 110, 110*a* and the corresponding button (not shown) for the flexing mechanism to actuate the random timed actuation of the drive motors such as 54, 56 and 76, as previously indicated, to vary the contour in a random fashion for the "putt out" to hole 6. Similarly the players repeat the random selection of the lights to mark the location of the "putt out" beginning by pushing random selection button 260 which results in the random selection of lights such as 9*a* and 9*aa* on console 11. The pushing of the random light selector button 260 also actuates solenoid 254 to open switches such as 273*a* and 273*b* to disconnect the manual switches so that the operation is only by random selection. The players then putt towards hole 6. When the first ball drops in hole 6, microswitch 270 is tripped opening switch 390 to disconnect solenoids 253 and 254 from power whereby transfer switches such as 242*a* and 242*b* return to their spring biased position shown in FIG. 11 connecting the "8" series lights into the circuit and disconnecting the "9" series so that the circuitry is set for play back towards hole 7.

The play is then back and forth as previously described until the desired number of "putt outs", such as 18 holes has been played. It is to be understood that when the device is coin-operated, a counting device known in the art (not shown) could be installed with coin-operated switch 102 to turn off the apparatus after microswitches 250 and 270 have been depressed a predetermined number of times.

Assume the players desire to challenge each other by manual selection of the putting surface contour and light selection. Under such circumstances, the players would select the contour by holding each manual selection switch down the length of time necessary to achieve the desired component for the contour. For example, while standing at console 10, the player would depress and hold switch 184 (FIG. 10) the time to achieve the desired raising or lowering of the putting surface adjacent beam 33 by rotation of motor 54 and its associated cam plate 58 until the desired height is achieved. He would then perform similar depressing of the manual switches for each of the motors, such as switch 184*a* for motor 56, and so forth. Similarly, a player would select the putting location light for his opponent by depressing a manual switch such as switch 280*a* to select the light 8*a* as the location for his opponent to commence putting. When putting from console 11 towards hole 6, the manual switches on console 11, such as switches 186 and 186*a* (FIG. 10) or switches 275*a* or 275*b* would be used.

It is to be understood that the players might play a variation wherein a portion of the contour is selected manually and a portion by random selection, with the locator lights sometimes being selected by random and sometimes manually, providing an interesting combination of variations.

I claim:

1. A miniature golf apparatus comprising:

supporting means for a putting surface, said supporting means including a plurality of flexible cross members spaced from each other, grid elements connected to said cross members with adjacent cross members having a plurality of said grid elements pivotally connected thereto to form a movable grid, a flexible putting surface operably connected to said grid elements, flex means operably connected to at least some of said flexible cross members to flex said members to curve said flex members and the putting surface, means to vary the relative height of adjacent of said flexible members to differently curve the putting surface, means to vary the relative height of the opposite ends of said flexible cross members to vary the slant of said flexible cross members and putting surface, whereby said putting surface is slanted, and is curved in more than one direction.

2. A miniature golf apparatus in accordance with claim 1 wherein;

said grid elements are generally fork shaped, said grid elements being mounted on said cross members whereby the single end of the fork shape of one element is mounted between the double ends of the fork shape of another element to form said grid.

3. A miniature golf apparatus in accordance with claims 1 or 2 wherein;

said grid elements are clips which terminate in generally C-shaped hooks which engage the cross members to provide the pivotal connection.

4. A miniature golf apparatus in accordance with claim 1 wherein said support means includes first and second beams extending lengthwise of said putting surface, said beams being rotatable and carrying said cross members, and drive means disposed to rotate each of said beams.

5. A minature golf apparatus in accordance with claim 4, wherein, projecting members extend from said beam, the cross members are pivotally connected to the projecting members, and the drive means is disposed to rotate each of said beams independently of the other whereby the height of one end of each cross member is variable independently from the height of the other end thereof so as to provide a widthwise slant of the cross-members and the putting surface disposed thereon.

6. A minature golf apparatus in accordance with claim 5, wherein, at least certain of said cross members and projecting members are of different lengths from adjacent cross members and projecting members whereby, rotation of the beams causes adjacent cross members to be of different heights, whereby a lengthwise undulation is provided to the putting surface.

7. A miniature golf apparatus comprising:

supporting means for a putting surface, said supporting means including, first and second lengthwise extending beams axially rotatable, drive means to rotate said beams about their axes, projecting members extending from each of said beams, flexible cross members pivotally connected to said projecting members, a flexible putting surface operably connected to said cross members, flex means operably connected to at least some of said flexible cross members to flex said members to curve said flex members and putting surface.

8. A miniature golf apparatus in accordance with claim 7 wherein;

said beams are rotatable independently of each other, said drive means being adapted to drive cross members independently of each other whereby the relative height of the ends of the projecting members of one beam are rotatable to a position higher than the relative height of the ends of the projecting members of the other beams so as to vary the slant of said flexible cross members and putting surface.

9. A miniature golf apparatus in accordance with claims 7 or 8 including;

at least certain of said cross members and projecting members are of different lengths from adjacent cross members and projecting members, whereby rotation of the beams causes adjacent cross members to be of different heights, whereby a lengthwise undulation is provided to the putting surface.

10. A miniature golf apparatus in accordance with claims 7 or 8 including;

a plurality of grid elements pivotally connected between said cross members to provide a grid to which said flexible putting surface is operably connected.

11. A minature golf apparatus in accordance with claim 1, wherein, said flex means includes a bracket means suspended from said cross members, motor means mounted on said bracket means, and arm means connected between said motor means and said bracket means to extend and contract to flex said cross-members to produce a curvature in said putting surface.

* * * * *